US006196036B1

(12) United States Patent
Andersen

(10) Patent No.: US 6,196,036 B1
(45) Date of Patent: Mar. 6, 2001

(54) TORQUE-LIMITED KEY

(75) Inventor: Jesper Alexander Andersen, Verona, NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 09/371,513

(22) Filed: Aug. 10, 1999

(51) Int. Cl.[7] ..... E05B 19/04
(52) U.S. Cl. ..... 70/408; 70/395; 70/432
(58) Field of Search ..... 70/395, 408, 432

(56) References Cited

U.S. PATENT DOCUMENTS

| | | | | |
|---|---|---|---|---|
| 591,901 | * | 10/1897 | Trotman | 70/395 |
| 602,561 | * | 4/1898 | Loomis | 70/395 |
| 729,773 | * | 6/1903 | Katz et al. | 70/432 X |
| 2,198,484 | * | 4/1940 | Merkl | 70/395 |
| 3,797,291 | * | 3/1974 | Simorghi | 70/395 |
| 4,018,069 | * | 4/1977 | Lipschutz | 70/395 |
| 4,297,863 | * | 11/1981 | Glock | 70/395 |
| 4,366,688 | * | 1/1983 | Bennett | 70/395 |
| 4,432,218 | * | 2/1984 | Hoener | 70/408 X |
| 4,631,943 | * | 12/1986 | Hoener | 70/395 |
| 5,029,459 | * | 7/1991 | Almblad | 70/395 |
| 5,595,080 | * | 1/1997 | Whinton | 70/432 |
| 5,870,917 | * | 2/1999 | Mahot et al. | 70/408 |

FOREIGN PATENT DOCUMENTS

| | | | | |
|---|---|---|---|---|
| 4203886 | * | 8/1993 | (DE) | 70/408 |
| 624138 | * | 7/1927 | (FR) | 70/408 |
| 634575 | * | 2/1928 | (FR) | 70/408 |
| 236199 | * | 8/1993 | (IT) | 70/432 |

* cited by examiner

*Primary Examiner*—Suzanne Dino Barrett

(57) ABSTRACT

A torque-limited key includes a grip and a lock or latch engaging member. A torque-limiting device connects the grip to the engaging member. The torque-limiting device may include a spring, a frictional engagement, or any other type of resilient member. The torque-limiting device allows a torque applied to the grip to rotate the engaging member, so long as the applied torque is less than a predetermined level. If the applied torque exceeds the predetermined level, the grip will rotate relative to the engaging member in order to prevent breaking the engaging member off inside the lock or latch, and also in order to prevent damaging the mechanism of the lock or latch.

20 Claims, 6 Drawing Sheets

TORQUE-LIMITED KEY

BACKGROUND OF THE INVENTION

1. Field of the Invention

The present invention relates to a key for opening a lock or latch.

2. Description of the Related Art

Keys are a common everyday tool used by nearly all of the population. Keys are used to restrict access to residential and commercial structures, automobiles, bicycles, post office boxes, toolboxes, moneyboxes, cash resisters, etc. The basic structure of a key has remained essential unchanged since its initial inception. Basically, a key includes a grip, which is held between the thumb and fingers of the user. A lock or latch engaging portion, such as a shaft is rigidly fixed to the grip, and coding is provided on the shaft. Typically the coding includes notches along one or two edges of the shaft and one or more grooves extending along the shaft.

Common keys suffer a major drawback. Often a lock will become difficult to operate with a key. The difficulty is usually due to the coding on the key's shaft becoming worn, or slight corrosion or contamination building up inside the lock's mechanism. Cutting a new key, or applying a cleaner/lubricate to the lock mechanism, can easily rectify these conditions. However, instead of fixing the problem, it is common that the person possessing the key will simply exert additional torque to the key in order to force the lock or latch to open.

Forcing the key to turn the lock may work for some period of time, however the additional applied torque causes the connection between the grip and shaft of the key to fatigue, and can also damage the lock's internal mechanism. Eventually, the connection between the grip and shaft will fail, and the key's shaft will be broken off inside the lock. When such an event occurs, it is very time consuming to remove the key's shaft from the lock. Usually, the lock must be removed and disassembled to remove the key's shaft, then reassembled and reinstalled. Often, it is more cost effective to throw away the lock and replace it with a new lock.

Therefore, there exists a need in the art for a key, which will not permit the key's operator to apply excessive torque when attempting to open the lock. Such a key would remind the key's operator to take the proper corrective action to fix the problem, e.g. clean/lubricate the lock or replace the worn key, instead of continuing to apply more and more torque to the key to open the lock. Further, such a key would reduce the labor associated with repairing a lock's mechanism to remove a broken key shaft, and the wasteful replacement of locks which are in good operating order except for the presence of the key's broken shaft lodged inside.

SUMMARY OF THE INVENTION

Accordingly, it is an object of the present invention to provide a key which reduces the likelihood of the key's shaft being broken off inside a lock or latch.

It is a further object of the present invention to provide a key, which reduces the likelihood of a user damaging a lock's inner mechanism by applying excessive torque to the key's grip.

According to the present invention a key is formed of a grip and a lock or latch engaging member. A torque-limiting device connects the grip to the engaging member. The torque-limiting device may include a spring, a frictional engagement, or any other type of resilient member. The torque-limiting device allows a torque applied to the grip to rotate the engaging member, so long as the applied torque is less than a predetermined level. If the applied torque exceeds the predetermined level, the grip will rotate relative to the engaging member in order to prevent breaking the engaging member off inside the lock or latch, and also in order to prevent damaging the mechanism of the lock or latch.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE INVENTION

Figure 1:
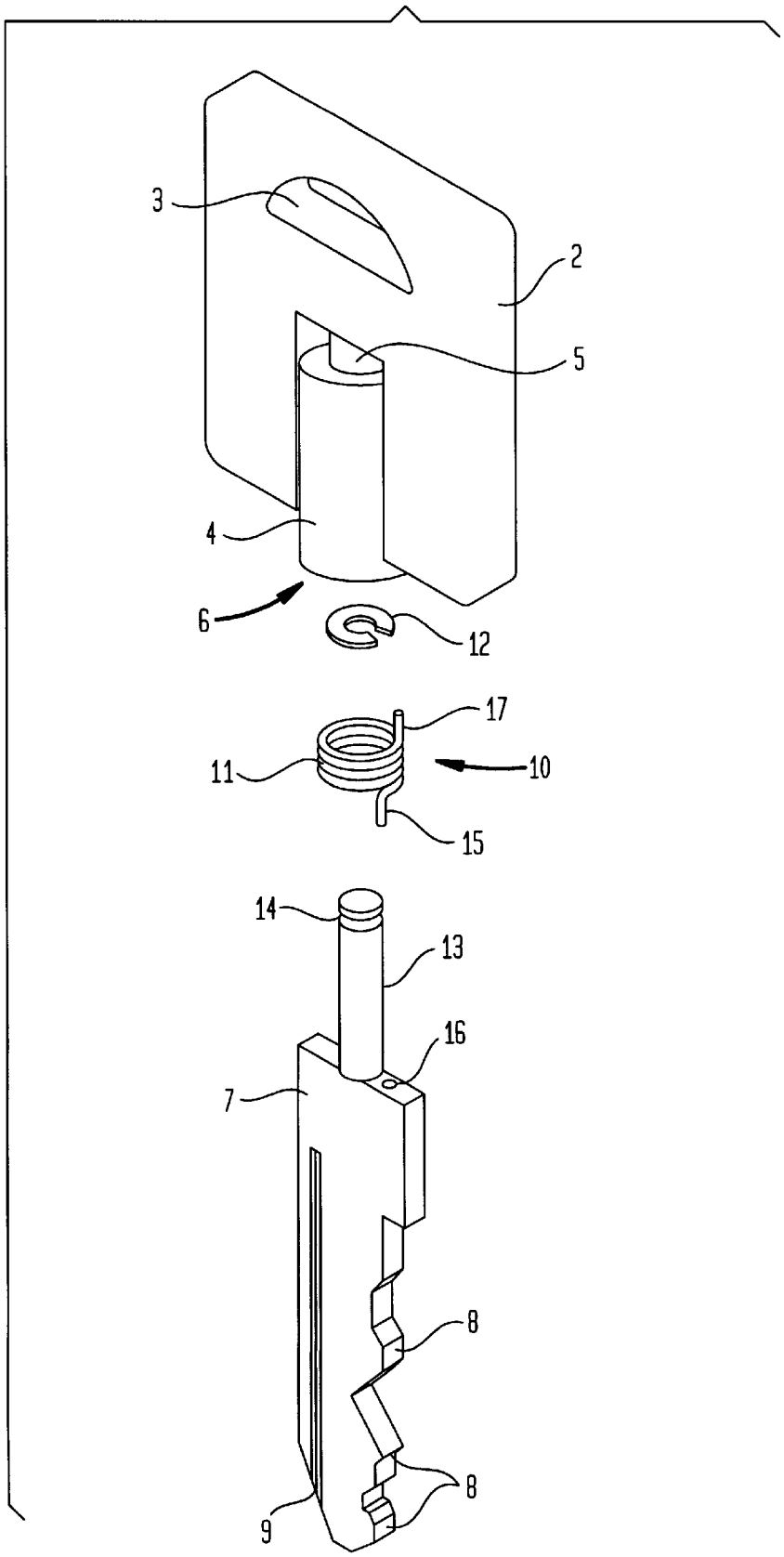
FIG. 1 is a perspective and exploded view of a torque-limited key, in accordance with the present invention.
Figure 2:
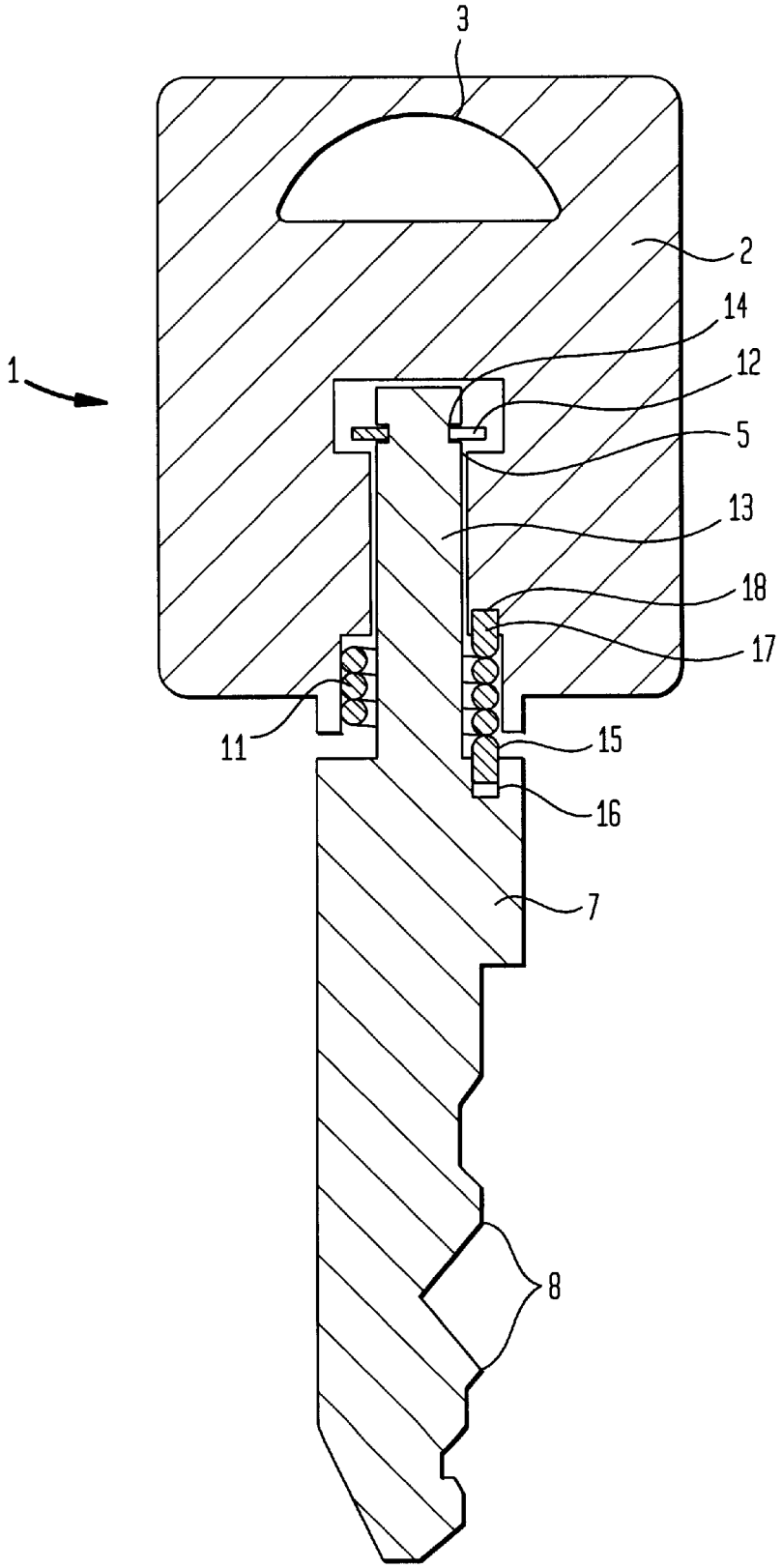
FIG. 2 is a cross sectional view of the key of FIG. 1 in assembled form.

FIGS. 1 and 2 illustrate a torque-limited key 1 in accordance with the present invention. The key 1 includes a grip 2 having a first through hole 3 for receiving a key ring. The grip 2 further includes a receiver in the form of a container 4. The container 4 may be integrally formed with the grip 2, or attached thereto by adhesives, or the like. A second through hole 5 is provided at an upper end of the container 4, and a lower end 6 of the container 4 is open.

A lock or latch engaging portion is provided in the form of a shaft 7. The shaft 7 includes a cylindrical upstanding projection 13 having a recessed ring 14 provided therein. The shaft 7 includes a plurality of key coding notches 8 along a front edge thereof. Of course, key coding notches 8 could also be provided along the back edge of the shaft 7. The shaft 7 also includes one or more grooves 9 extending parallel to the front and back edges of the shaft 7. The notches 8 and grooves 9 are provided to mate the shaft 7 to one or more locks, as is well known in the existing arts.

A torque limiter 10 is provided intermediate the grip 2 and shaft 7. The torque limiter 10 includes a coil spring 11 and a spring clip 12. The coil spring 11 encircles the upstanding portion 13. A first tang 15 of the coil spring 11 is inserted into a first bore 16 formed in the shaft 7. A second tang 17 of the coil spring 11 is inserted into a second bore 18 formed in the grip 2. The recessed ring 14 is passed through the second through hole 5 of the upper end of the container 4, and the spring clip 12 is engaged around the recessed ring 14. The key 1 is now assembled.

Figure 3:
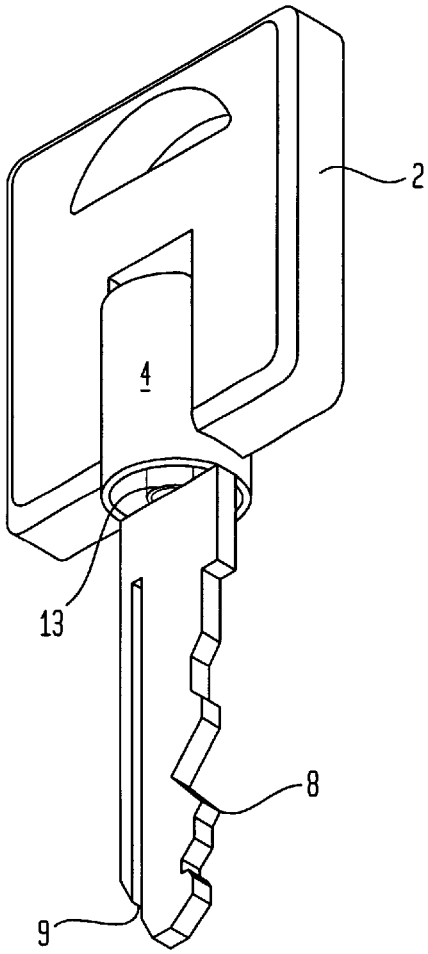
FIG. 3 is a perspective view of the key in an under-torqued condition.
Figure 4:
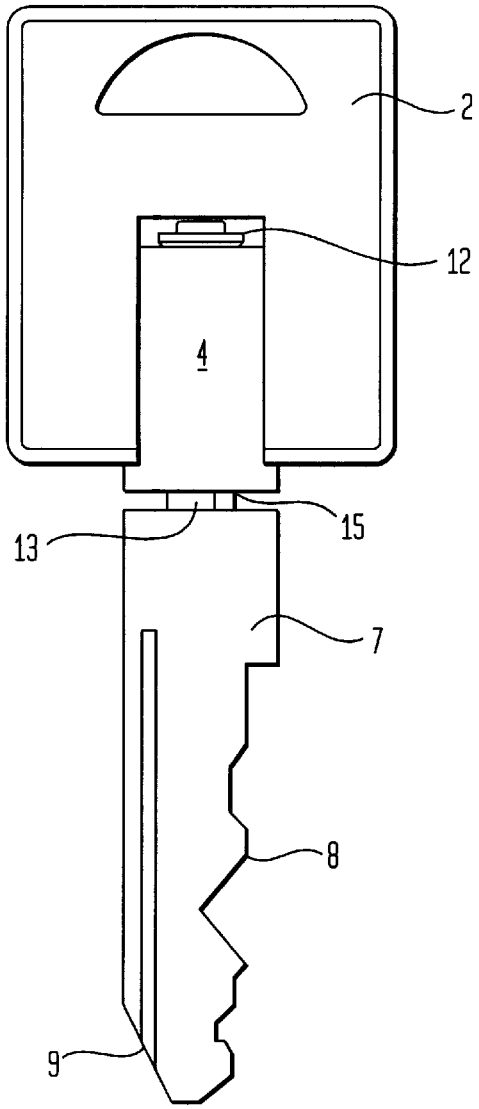
FIG. 4 is a front view of the key of FIG. 3.
Figure 5:
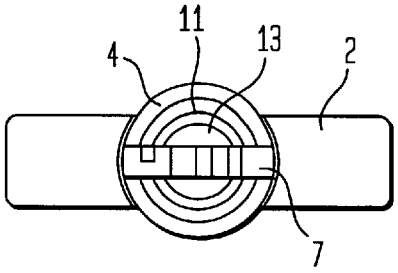
FIG. 5 is a bottom view of the key of FIGS. 3 and 4.

The assembled key 1 has several distinctive features. First, as illustrated in FIGS. 3–5, the relative alignment of the first and second tangs 15, 17 and the first and second bores 16, 18 is such that the shaft 7 is naturally coplanar with the grip 2. This arrangement resembles a common key configuration.

Once the shaft 7 is inserted into a lock and a torque is applied to the grip 2, the coil spring 11 experiences a torsion force which would tend to unwind the coil spring 11. The coil spring 11 has a resilience factor greater than a predetermined level of this torsion force. In other words, the shaft 7 will remain coplanar with the grip 2 until the predetermined level of torsion force is surpassed.

Figure 6:
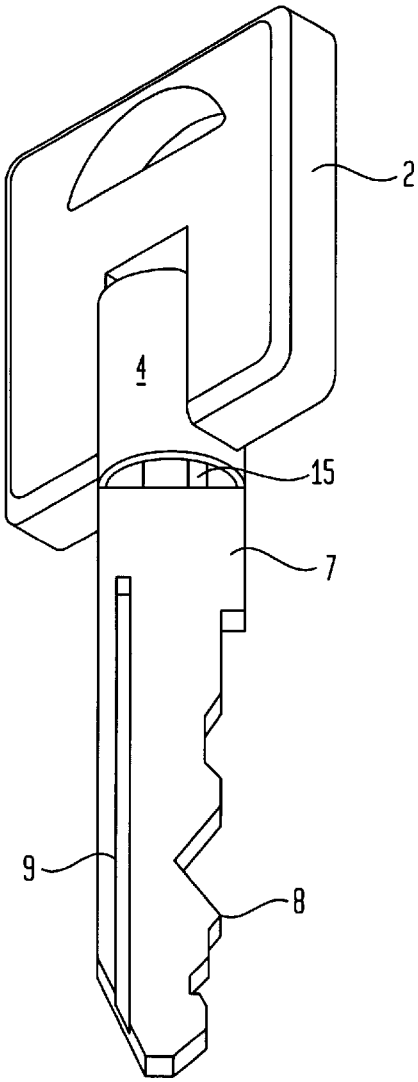
FIG. 6 is a perspective view of the key in an over-torqued condition.
Figure 7:
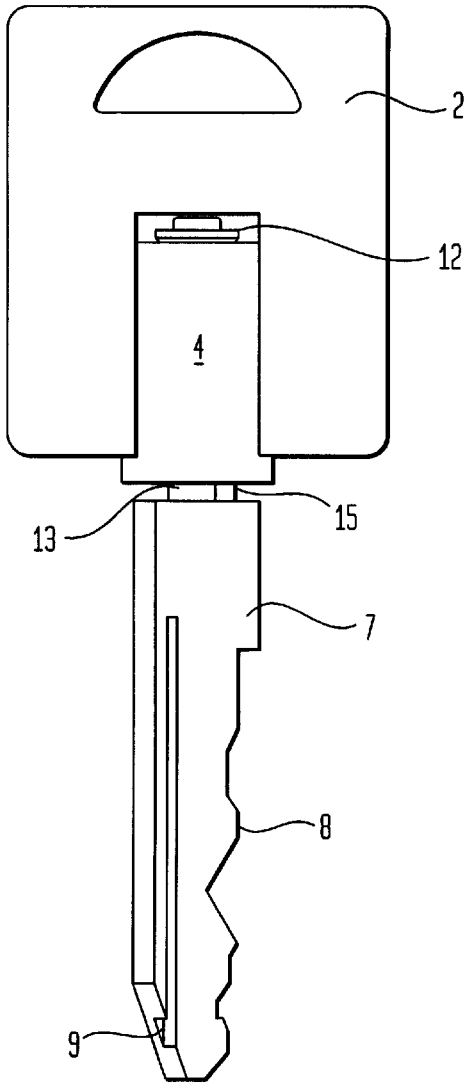
FIG. 7 is a front view of the key of FIG. 6.
Figure 8:
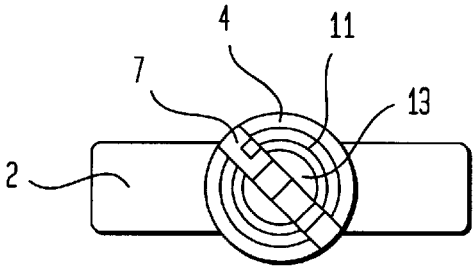
FIG. 8 is a bottom view of the key of FIGS. 6 and 7.

After the predetermined level of force is surpassed, the coil spring 11 begins to unwind allowing the grip 2 to rotate relative to the shaft 7, as illustrated in FIGS. 6–8. In practice, what occurs is that if the lock is overly resistant to rotating and the operator applies excessive torque to the grip 2, i.e. a torque greater than the predetermined level, the grip 2 will rotate relative to the shaft 7 instead of transmitting the applied torque to the shaft 7. Rotation of the grip 2 relative to the shaft 7 indicates to the user that the key 1 or lock needs servicing. Once the person releases the grip 2 and the key 1 will simply return to its normal untorqued configuration wherein the shaft 7 is coplanar with the grip 2, as illustrated in FIGS. 3–5.

Figure 9:
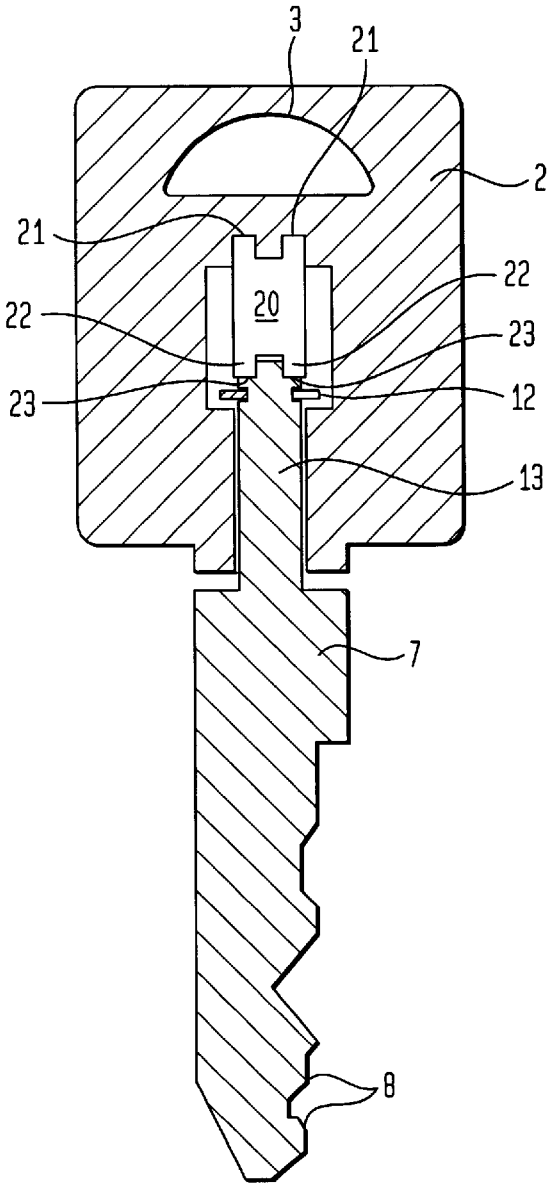
FIG. 9 is a cross sectional view, similar to FIG. 2, illustrating a first alternative embodiment of the torque limiter.

FIG. 9 illustrates a first alternative embodiment of the torque limiter 10. Here, the coil spring 11 has been replaced by a leaf spring 20. The leaf spring 20 includes two upper tangs 21 embedded within the grip 2 and two lower tangs 22 engaged within slots 23 of the upstanding projection 13. The leaf spring 20 has a natural resilience that tends to keep the leaf spring 20 planar. When the leaf spring 20 is planar, the grip 2 and shaft 7 are coplanar, as illustrated in FIGS. 3–5.

When a user applies a torque, in excess of a predetermined level, to the grip 2, the leaf spring 20 begins to twist about its center. The twisting of the leaf spring 20 prevents the excessive torque applied to the grip 2 from being transmitted to the shaft 7. When the leaf spring 20 twists, the grip 2 rotates relative to the shaft 7, as illustrated in FIGS. 6–8. When the excessive torque is removed from the grip 2, the natural resilience of the leaf spring 20 causes the grip 2 to reassume a coplanar relationship with the shaft 7, as illustrated in FIGS. 3–5.

Figure 10:
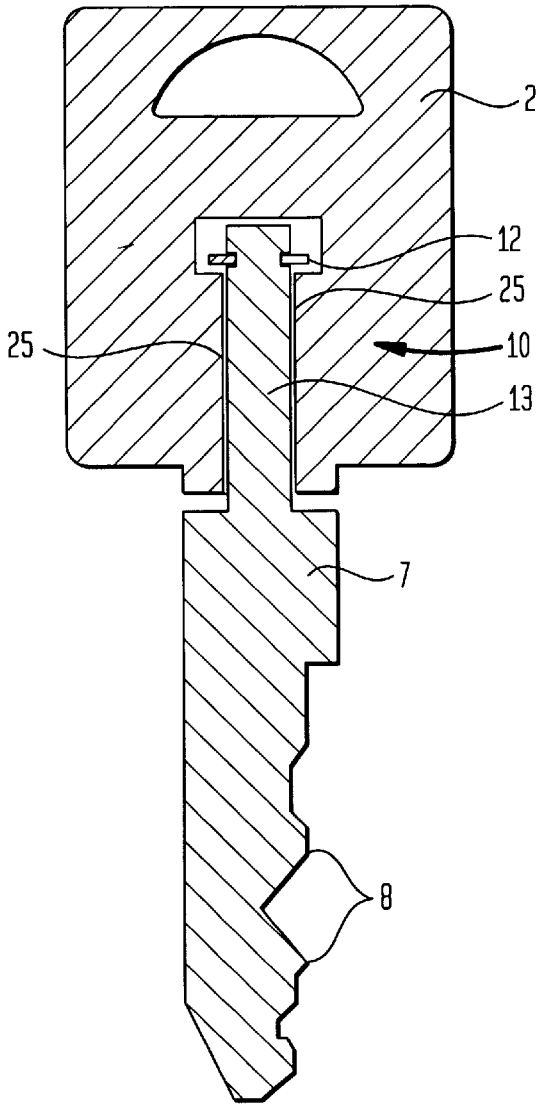
FIG. 10 is a cross sectional view, similar to FIG. 2, illustrating a second alternative embodiment of the torque limiter.

FIG. 10 illustrates a second alternative embodiment of the torque limiter 10. Here, the coil spring 11 has been removed. Sidewalls 25 of the container 4 are reduced in size such that a frictional engagement is formed between the sidewalls 25 and the upstanding projection 13. The static coefficient of the frictional engagement is set to correspond to the predetermined level of torque which should not be exceeded. When no torque is applied to the grip 2 , the shaft 7 is coplanar with the grip 2, as illustrated in FIGS. 3–5.

When a user applies a torque, in excess of the predetermined level, to the grip 2, the static coefficient of friction between the sidewalls 25 and the upstanding projection 13 is exceeded, and the upstanding projection 13 rotates inside the sidewalls 25. This rotation equates to the grip 2 rotating relative to the shaft 7, as illustrated in FIGS. 6–8. The rotation of the upstanding projection 13 inside the sidewalls 25 prevents the excessive torque applied to the grip 2 from being transmitted to the shaft 7. After the excessive torque is removed from the grip 2, the shaft 7 will remain in the non-coplanar state illustrated in FIGS. 6–8. If the user desires the coplanar state of FIGS. 3–5, the user must manually rotate the grip 2 relative to the shaft 7.

Figure 11:
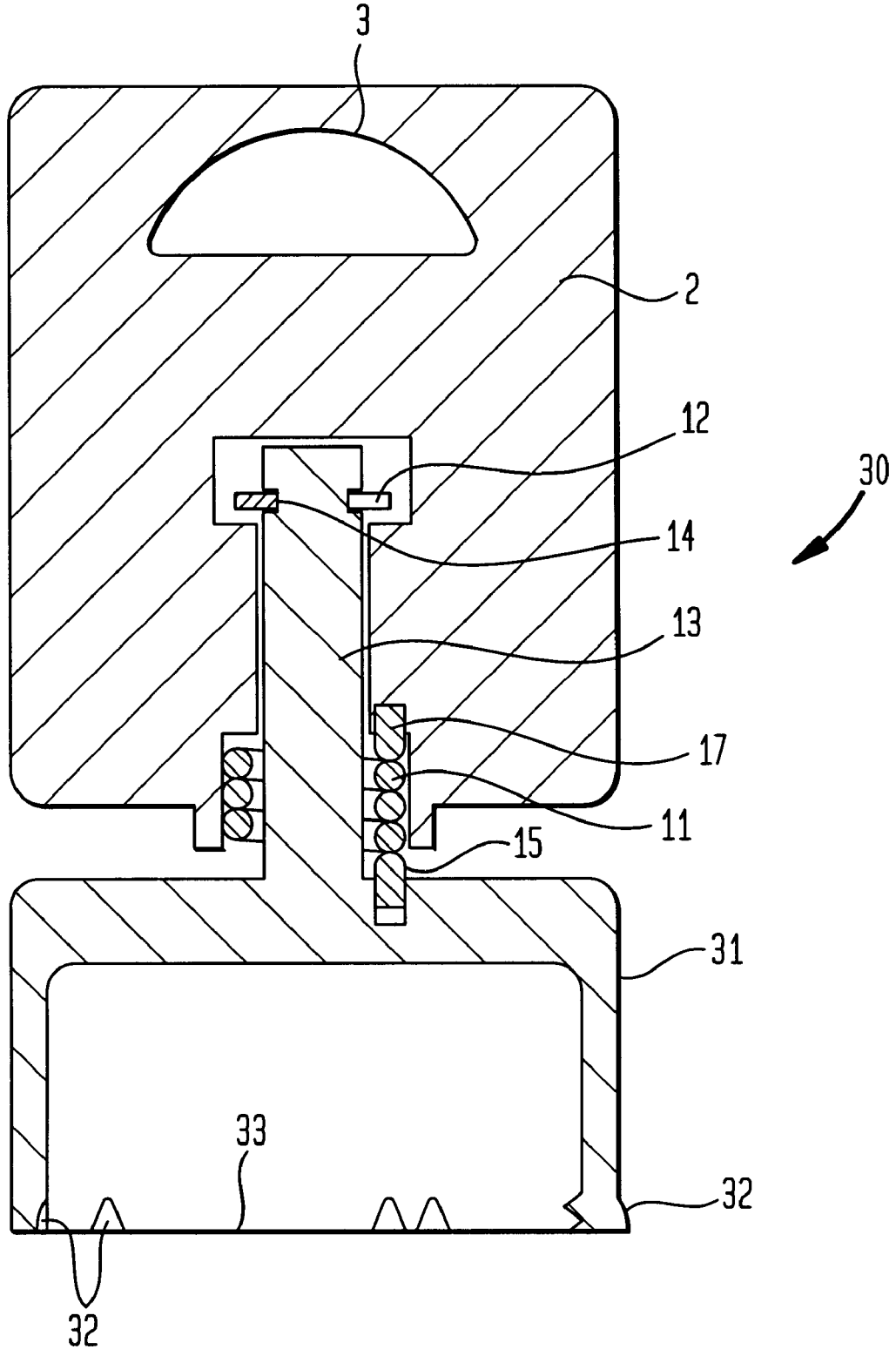
FIG. 11 is a cross sectional view, similar to FIG. 2, illustrating a barrel type key shaft.

FIG. 11 illustrates how the invention is applicable to a barrel style key 30. A barrel style key 30 has an open ended cylindrical member 31 attached to the grip 2. The cylindrical member 31 includes key coding 32 along its open end 33. The existence and operation of barrel style keys 30 is well known in the existing arts. By the present invention, any one of the torque limiters 10, illustrated in FIGS. 2, 9 or 10, may be applied between the grip 2 and the cylindrical member 31.

The invention being thus described, it will be obvious that the same may be varied in many ways. For example, other types of springs, resilient members, or frictional engagements may be used in the torque limiter 10. Further, any type of key or activator for opening a lock or simple latch can benefit from the torque limiter 10. Such variations are not to be regarded as a departure from the spirit and scope of the invention, and all such modifications as would be obvious to one skilled in the art are intended to be included within the scope of the following claims.

I claim:

1. A key having features to prevent an application of excessive force when actuating a mechanism of a lock or latch, said key comprising:

a grip;

a lock or latch engaging member rotatably attached to said grip at a connection, said connection allowing said grip to rotate said engaging member when a first torque less than a predetermined level is applied to said connection and not allowing said grip to rotate said engaging member when a second torque greater than said predetermined level is applied to said connection, wherein said first torque is sufficient to actuate a lock or latch.

2. The key according to claim 1, wherein said connection is a press fit relationship between said grip and said engaging member, which establishes a predetermined friction between said grip and said engaging member, and wherein said first torque is insufficient to overcome said predetermined friction, and said second torque overcomes said predetermined friction, such that said grip rotates relative to said engaging member.

3. The key according to claim 2, wherein said press fit relationship includes a container attached to said grip and a portion of said engaging member frictionally engaged within said container.

4. The key according to claim 1, wherein said connection includes a spring connected between said grip and said engaging member, which returns said grip and said engaging member to an original orientation once said second torque is removed.

5. The key according to claim 4, wherein said spring is a coil spring.

6. The key according to claim 5, wherein said coil spring at least partially uncoils when said predetermined level is exceeded.

7. The key according to claim 4, wherein said spring is a leaf spring.

8. The key according to claim 7, wherein said leaf spring includes a first end cooperating with said grip and a second end cooperating with said engaging member.

9. The key according to claim 1, wherein said engaging member includes a shaft with key coding notches along at least one edge of said shaft.

10. The key according to claim 9, wherein said shaft further includes at least one groove formed in said shaft, with said at least one groove paralleling said at least one edge.

11. The key according to claim 1, wherein said engaging member includes a cylindrical member having key coding notches formed along an open perimeter edge of said cylindrical member.

12. A key having features to prevent an application of excessive force when actuating a mechanism of a lock or latch, said key comprising:

a grip;

a torque limiter attached to said grip; and a key coded member attached to said torque limiter, said torque limiter allowing said grip to rotate said key coded member when a first torque less than a predetermined level is applied to said torque limiter and not allowing said grip to rotate said key coded member when a second torque greater than said predetermined level is applied to said torque limiter, wherein said first torque is sufficient to actuate a lock or latch.

13. The key according to claim 12, wherein said torque limiter includes a receiver attached to one of said grip and said key coded member and a portion of the other of said grip and said key coded member being frictionally engaged with said receiver, such that said portion slips relative to said receiver when said predetermined level is exceeded.

14. The key according to claim 12, wherein said torque limiter includes a coil spring which at least partially uncoils when said predetermined level is exceeded.

15. The key according to claim 12, wherein said torque limiter includes a leaf spring which twists when said predetermined level is exceeded.

16. The key according to claim 12, wherein said key coded member includes a shaft with notches along one edge of said shaft and with a groove extending parallel to said one edge.

17. The key according to claim 12, wherein said key coded member includes a cylindrical member having notches formed along an open perimeter edge of said cylindrical member.

18. A method of operating a key comprising:

providing a key having a grip and a lock or latch engaging member attached to the grip;

engaging the engaging member with a lock or latch;

rotating the grip in a first direction; and turning the engaging member in the first direction sufficient to actuate the lock or latch when a first torque applied to the grip is less than or equal to a predetermined level and not turning the engaging member in the first direction when a second torque applied to the grip exceeds the predetermined level.

19. The method according to claim 18, wherein said step of engaging includes inserting the engaging member into a keyhole.

20. The method according to claim 18, wherein said second torque causes said grip to rotate relative to said engaging member and indicates a malfunction of the lock or latch.

* * * * *